United States Patent [19]

Hedrick

[11] Patent Number: 4,460,121

[45] Date of Patent: Jul. 17, 1984

[54] THERMALLY CONTROLLED VENT DAMPER

[75] Inventor: Warren R. Hedrick, Holland, Mich.

[73] Assignee: Interpace Corporation, Parsippany, N.J.

[21] Appl. No.: 417,335

[22] Filed: Sep. 13, 1982

[51] Int. Cl.[3] ..... F23N 3/00

[52] U.S. Cl. ..... 236/1 G; 126/292; 236/45; 236/10 D

[58] Field of Search ..... 236/1 G, 93 R, 101 B, 236/101 D, 45; 251/305, 308; 403/161, 163, 164; 248/291, 289.1, 185; 126/292

[56] References Cited

U.S. PATENT DOCUMENTS

| | | | |
|---|---|---|---|
| 1,659,875 | 2/1928 | Jacobs | 236/93 R |
| 1,711,901 | 5/1929 | Nelson . | |
| 1,770,339 | 7/1930 | Lake . | |
| 1,784,608 | 12/1930 | Meyers . | |
| 2,220,630 | 11/1940 | Trethewey . | |
| 2,975,975 | 3/1961 | Weber . | |
| 3,174,687 | 3/1965 | Gilbert | 236/101 B X |
| 3,250,235 | 5/1966 | McDonnell | 248/289.1 X |
| 3,366,333 | 1/1968 | Diehl . | |
| 4,114,805 | 9/1978 | Humphreys et al. . | |
| 4,165,833 | 8/1979 | Nagel . | |
| 4,205,783 | 6/1980 | Dietsche et al. . | |
| 4,225,080 | 9/1980 | Barth . | |
| 4,236,668 | 12/1980 | Prikkel | 236/1 G |
| 4,273,283 | 6/1981 | Edwards . | |
| 4,289,271 | 9/1981 | Barth . | |

*Primary Examiner*—William E. Tapolcai

*Attorney, Agent, or Firm*—Varnum, Riddering, Schmidt & Howlett

[57] ABSTRACT

A thermally operated vent damper wherein a flue pipe (12) mounts an eliptical damper plate (38) for rotation about a hollow rod (30). A slot (42) is formed in the damper plate (38) by bending a flange (44) perpendicular to the plane of the damper plate (38) and providing an opening for a coil (52) of bimetallic material. The coil (52) controls the movement of the damper plate between closed and opened positions responsive to temperature in the flue pipe (12). An opening (19) in the flue pipe adjacent to the coil (52) provides a means for maintaining the coil (52) temperature lower than the flue gas temperature and for controlling the opening of the damper plate in the flue pipe in inverse proportion to the draft therein. A second bimetallic coil (60) is mounted outside the flue pipe to relieve stresses on the first bimetallic coil during prolonged high temperature excursions within the flue pipe.

12 Claims, 4 Drawing Figures

THERMALLY CONTROLLED VENT DAMPER

BACKGROUND OF THE INVENTION

1. Field of the Invention

This invention relates to thermally actuated vent dampers for fuel-fired heating apparatus such as gas-fired water heater- and gas-fired furnaces.

2. State of the Prior Art

It is known that vents on water heaters and furnaces continuously vent room air from the home or building structure when the heater or furnace is not in a combustion mode. In order to block unwanted escape of room air through the exhaust flue, various thermally operated vent dampers have been devised. These dampers open when heated combustion products are being generated and close when combustion is terminated. Some of these devices rely on bimetallic elements which change shape upon a change in temperature. Due to the mass of these elements and the structure surrounding the elements, these elements change temperature slowly. Thus, when combustion is terminated, there is a certain lag time during which the vent remains open and warm room air escapes through the exhaust flue. Heat energy is therefore lost during this lag time in which the damper valve remains open.

During periods of time in which combustion is taking place and the damper is open, the amount of dilution air which enters the draft is dependent on the temperature of the exhausting combustion gases, the wind velocity at the flue outlet and certain architectural features of the building structure itself. In some instances, the wind and architectural features can increase the draft beyond that necessary to exhaust all of the combustion products and unnecessarily draw additional room air from the building.

Examples of prior art vent dampers in which bimetallic elements are used are disclosed in the following U.S. Pat. Nos. and patent application:

Trethewey, 2,220,630, issued Nov. 5, 1940
Diehl, 3,366,333, issued Jan. 30, 1968
Lake, 1,770,339, issued July 8, 1930
Barth, 4,289,271, issued Sept. 15, 1981
Barth, 4,386,731, issued June 7, 1983
Meyers, 1,784,608, issued Dec. 9, 1930
Barth, 4,225,080, issued Sept. 30, 1980

Bimetallic elements have been used in other thermally actuated devices such as air register ventilators. See, for example, the U.S. Pat. No. to Weber 2,975,975, issued Mar. 21, 1961, and Edwards, U.S. Pat. No. 4,273,283, issued June 16, 1981.

Bimetallic elements used in vent dampers are subject to damage due to overheating. It is necessary to provide limits for the movement of the damper valve. If bimetallic elements are stressed at the limits of movement of the damper valve, especially when the elements are hot, fatigue damage can result. It is therefore important to relieve the stresses on bimetallic elements during extended high temperature excursions in the pipe.

The Barth patent discloses a device in which two spirally wound bimetallic elements are joined end to end. These elements are opposite in orientation so that one tends to open the valve and the other tends to close the valve. The second element is shielded and has a heat sink so that there is a delay before the second element operates.

SUMMARY OF THE INVENTION

According to the invention, the thermally operated vent damper is adapted to open quickly when combustion begins and close quickly when combustion ceases. Further, the relative position of the valve during the combustion process is automatically regulated to maintain an inverse relationship between the amount of draft in the pipe and the valve opening in the pipe so as to minimize unnecessary energy losses. Further, the bimetallic elements are protected from overheating without expensive shields or heat sinks.

The vent damper according to the invention comprises a flue pipe having a damper plate mounted therein for rotation about an axis transverse to the axis of the pipe and between a first position transverse to the flow of gases through the flue pipe and a second position parallel to the flow of gases through the flue pipe. A coil of bimetallic material is mounted concentrically about the axis of rotation of the damper plate and within the flue pipe adjacent to one side thereof. One end of the coil of bimetallic material is coupled to the flue pipe and the other end is coupled to the damper plate such that the coil, when heated, rotates the damper plate from the first position to the second position. An opening in the side of the flue pipe adjacent to the coil of bimetallic material permits ambient air to be drawn into the flue pipe and through the coil of bimetallic material before being substantially diluted in the heated flue gases to cool the coil and thereby maintain an inverse relationship between the draft in the pipe and the degree to which the damper plate moves between the first and second positions.

The damper plate has a slot at one side thereof and the coil of bimetallic material is positioned in the slot. The damper-plate slot is formed preferably by bending a first flange portion of the plate perpendicular to the plane of the plate. A rod extends through the flue pipe and through the flange portion on the damper plate to mount the damper plate for rotation. A second flange portion on the opposite side of the damper plate is also bent perpendicular to the plane of the damper plate to provide a second mounting means for the damper plate and to provide a slot on the side of the damper plate opposite the first flange position. The rod extends through the second flange portion. Preferably, bearings are mounted in both the first and second flange portions of the damper plate.

Means are provided for rotating the rod in the same direction of rotation as the damper plate moves during the heating cycle upon prolonged heating or high temperature excursions within the flue pipe to relieve the stress on the bimetallic coil. This rotation means comprises a second coil of bimetallic material which is mounted in a position shielded from gases in the flue pipe, opposite to the side at which the first coil of bimetallic material is mounted, and concentric with the rod which mounts the damper plate. One end of the coil of bimetallic material is secured to the rod and the other end thereof is mounted to the flue pipe, preferably through an adjustment means which allows adjusting the bias on the damper plate in the first position. The first coil is coupled to the flue pipe through the rod and through the second coil. To this end, the inner end of the first coil is secured to the mounting rod for the damper plate.

BRIEF DESCRIPTION OF THE DRAWINGS

The invention will now be described with reference to the accompanying drawings in which.

DESCRIPTION OF THE PREFERRED EMBODIMENT

Figure 1:
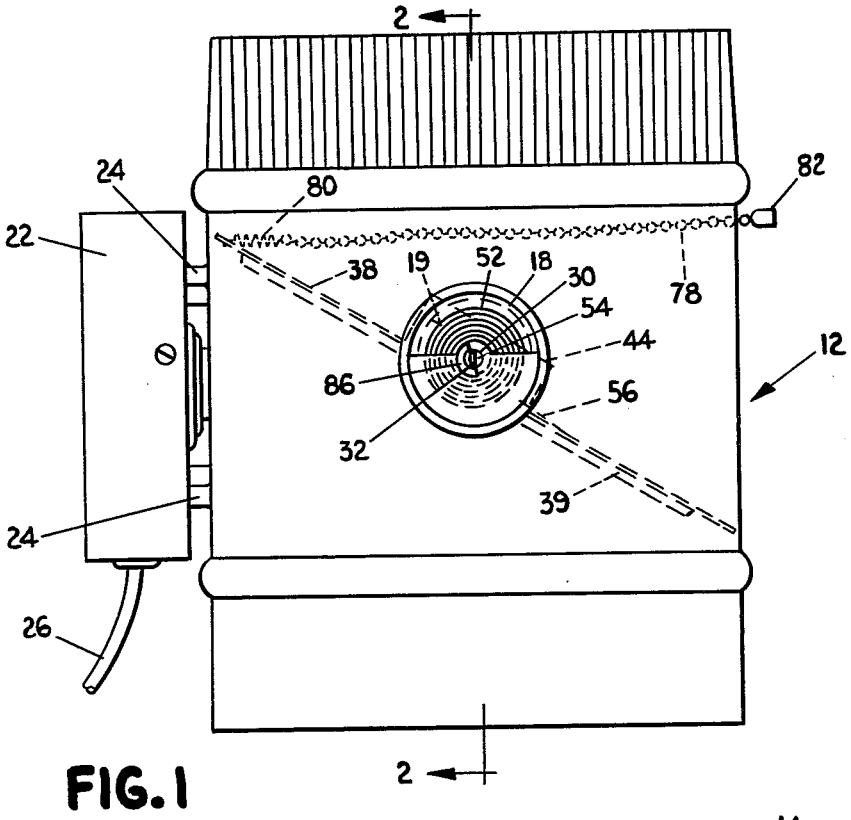
FIG. 1 is a side elevational view of a flue pipe with a vent damper according to the invention.
Figure 2:
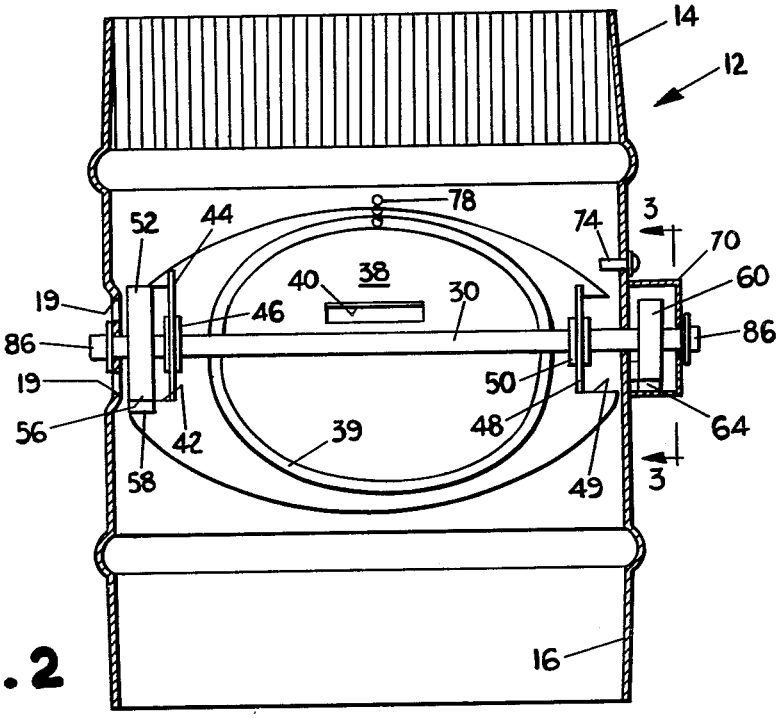
FIG. 2 is a front elevational view seen along lines 2—2 of FIG. 1.

Referring now to the drawings, there is shown a vent damper comprising a metal flue pipe 12 having crimped outlet end 14 and an open inlet end 16. A circular depression 18 is formed in one side of the flue pipe 12 and a semicircular opening 19 is removed from the circular depression 18. A circular opening 20 is formed in the flue pipe 12 on a side opposite to the opening 19. A circular opening also is provided in the web 20.

A thermally operated switch 22 is mounted to the flue pipe through the stand-off dimples 24 to sense the temperature of the flue gas, principally near the inlet end 16 thereof. To this end, an opening (not shown) is provided in the flue pipe at the switch 22. The switch 22 is adjacent to this opening and is in the path of flue gas spilled through the flue pipe hole. Electrical wires 24 are connected to the thermally operated switch 22 and are also connected in series with the control means (not shown) to deactivate the supply of gas to the furnace in the event that the temperature as sensed by the thermally operated switch exceeds a predetermined value.

A hollow rod 30 is mounted in the opening in the web 20 at one end and extends through the opening 22 at the other end thereof. Slots 32 and 34 are formed in the respective ends of the hollow rod 30. The hollow rod 30 can be made from stainless steel tubing or can be made by rolling a blank of sheet stainless steel.

An elliptical damper plate 38 having an elongated opening 40 is mounted for rotation on the hollow rod 30 through a flange 44 and a flange 48. The flanges 44 and 48 are formed by cutting and bending a portion of the damper plate 38, thereby leaving slots 42 and 49. An elliptical deboss 39 is formed in the damper plate 38 to rigidify the plate on the larger sizes when needed. Bearings 46 are mounted in an opening in the flange 44 for mounting the hollow rod 30. Likewise, a bearing 50 is positioned in an opening in the flange 48 to mount the other side of the damper plate 38 on the hollow rod 30. The bearings 46 and 50 are made from a graphite-filled bronze material.

A bimetallic coil 52 is positioned in the slot 42 of the damper plate and is wound around the rod 30. The inner end of the bimetallic coil 52 is positioned within the slot 32 of rod 30 and the outer end 56 of the bimetallic coil 52 is bent along the lower portion of the damper plate 38 and is bent backwardly through an elongated opening 40 therein.

A second bimetallic coil 60 is positioned on the other end of the rod 30 with the inner end 62 of the coil 60 extending through the slot 34 in the rod 30 and the outer end 64 secured to the flue pipe 12. To this end, the outer end 64 is bent parallel to the flue pipe and a sheet metal screw 66 extends therethrough into one of three or more holes 68 in the side of the flue pipe. A circular housing 70 surrounds the second bimetallic coil 60. A tab 72 on housing 70 extends coextensively with the outer end 64 of the second bimetallic coil. The sheet metal screw 66 extends through a hole (not shown) in the tab 72. A rivet 74 extends through the flue pipe 12 above housing 70 to form a stop for the damper plate 38 in its open position.

Figure 3:
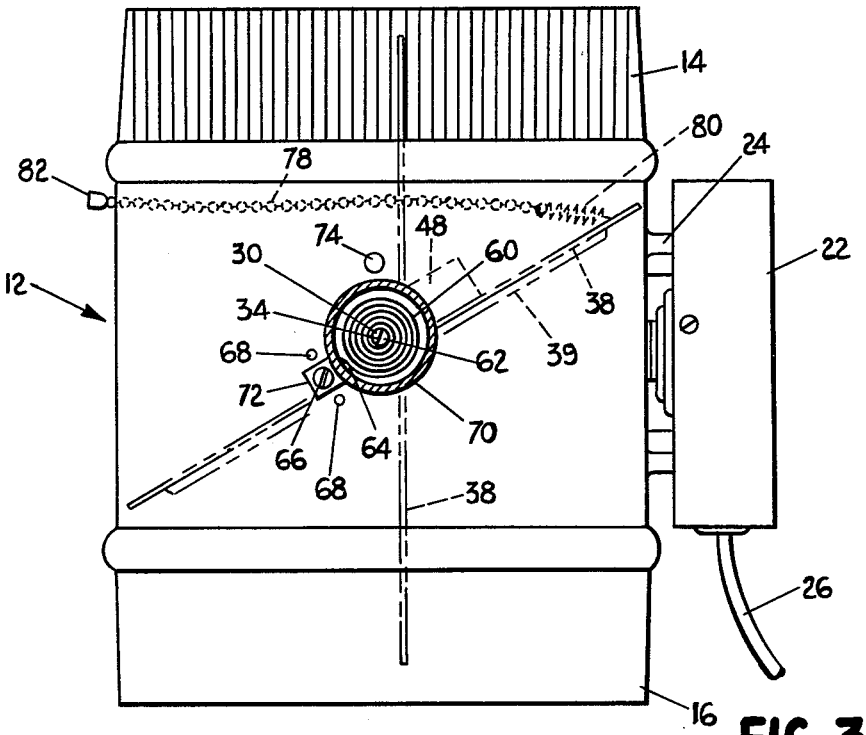
FIG. 3 is a side view of the vent damper from a side opposite to FIG. 1 and partly in section as seen along lines 3—3 of FIG. 2.
Figure 4:
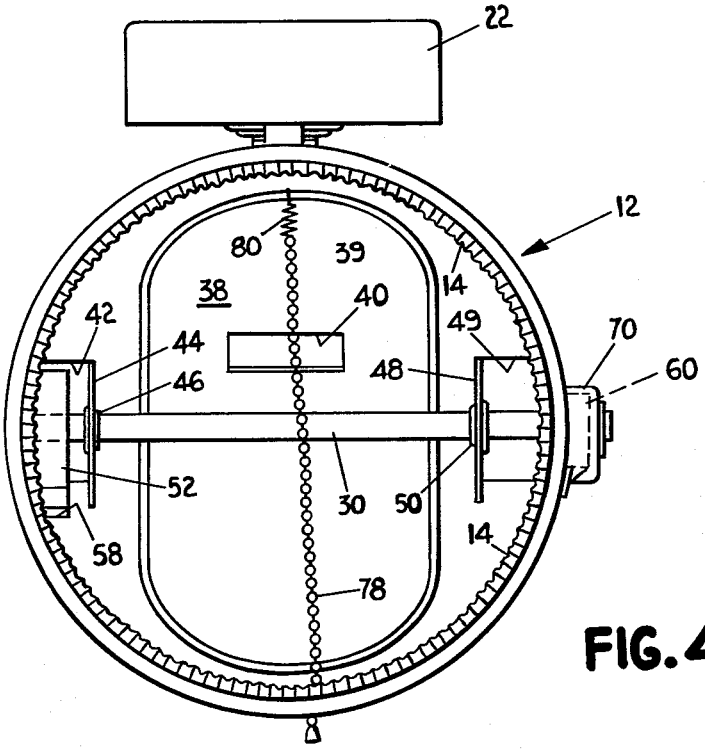
FIG. 4 is a top view of the vent damper.

The bimetallic coils are made by laminating strips of two different metals which have different thermal expansion coefficients. These bimetallic coils are well known and are commercially available. The two coils used in this embodiment of the invention are adapted to tighten when heated. Thus, the coil 52 tends to rotate the damper plate 38 is a clockwise direction as viewed in FIG. 1. The coil 60 tends to rotate the rod 30 in a counterclockwise direction as viewed in FIG. 3.

Push-cap nuts 86 are retained on each end of hollow rod 30 to secure the same in place within the flue pipe. The visible push-cap nut 86 in FIG. 1 is partially broken away to show the slot 32 in the rod 30.

A ball chain 78 having an end cap 82 is connected at one end to the flue pipe 12 through a keyhole slot and at the other end to a coil spring 80. The spring 80 in turn is connected to the upper end of the damper plate 38.

In operation, the elliptical damper plate 38 is positioned in a closed position as illustrated in FIG. 1 under normal conditions when the furnace is off to substantially close off the flow of gases through the flue pipe. The opening 40 and slots 42, 49 in the damper plate allow escape of the gases from the pilot light without allowing a significant amount of room air to be exhausted through the flue pipe. A certain amount of room air will also pass through the semicircular opening 19 in the flue pipe and through the bimetallic coil 52 but, under normal conditions, the amount of air passing through these openings will be relatively small because the draw on the flue pipe will be relatively small under these conditions. The second bimetallic coil 60 is designed and mounted so that a slight preload or closed bias is applied to damper plate 38. Holes 68 provide a means for adjusting this bias or preload after assembly of the unit. The chain 78 and spring 80 are provided for the purposes of manually opening the valve in the event that the bimetallic element ever fails to do so and emergency operation is desired.

When the temperature control for the building structure or water heater, as the case may be, calls for heat, the burners will be started in a conventional fashion. The products of combustion will initially pass through the elongated opening 40 and through the slots 42, 49 in the damper plate 38. These gases will be heated and will tend to heat the bimetallic element 52. As the bimetallic element is heated, the coil tightens to thereby rotate the damper plate 38 in a clockwise direction as viewed in FIG. 1 (counterclockwise as viewed in FIG. 3) after overcoming the preload until the damper plate 38 reaches an equilibrium position. In high temperature excursions, the damper plate 38 will come in contact with the rivet 74 so that the damper plate 38 is maintained in a substantially vertical position for maximum escape of flue gases. During the period of time that the combustion gases are passing through the flue pipe 12, a draft is created therein, thereby drawing room air in through the semicircular opening 19 and through the bimetallic coil 52. In this manner, the bimetallic coil 52 is maintained at a lower temperature than it would otherwise be and the damper plate 38 opens somewhat less than it otherwise might. The bimetallic element 52 is adjusted so that the damper plate 38 is opened only enough to insure that all products of combustion are removed from the building. The introduction of air through the pipe and over the bimetallic coil 52 reduces the temperature of the coil and provides an inverse relationship between the amount of draft in the pipe (due to temperature differentials or wind) and the opening of the damper valve.

As the temperature continues to build up in the flue pipe 12, the second bimetallic coil 60 will be heated. The heating of the second bimetallic coil 60 will rotate the hollow rod 30 in a counterclockwise direction as viewed in FIG. 3 (clockwise as viewed in FIG. 1). Therefore, upon continued heating of the flue pipe 52, the second bimetallic coil 60 rotates the hollow rod 30 so as to decrease the stress on the bimetallic coil 52.

If the temperature in the flue pipe 12 gets too high as sensed by the thermally operated switch 22, the fuel supply to the furnace will be cut off. Such a condition might exist if the baffle plate 38 does not open as expected when the bimetallic coil 52 heats up or the flue is otherwise blocked.

When the fuel supply to the furnace is cut off, the heating of the gas flowing through the pipe will cease. However, there will be a substantial draft remaining in the pipe which will draw in room air over the coil 52. In this manner, the coil will be rapidly cooled and the rapid cooling of the coil 52 will close the damper plate 38 quicker than it would otherwise be closed without the cooling effect from the room air. The heated second bimetallic coil 60 may also aid in closing of the damper plate 38 quicker than it otherwise would close without the second bimetallic coil 60 if it has rotated the hollow rod 30 part way.

Thus, the invention provides a simple and inexpensive damper valve which will open quickly when heat builds up in the flue pipe but will open only sufficiently to allow exhaust of all of the combustion products so as to minimize energy losses through the flue pipe. The invention provides a means for relieving the stress on the bimetallic coil 52 after the coil has rotated the damper plate to its full open position. The invention further provides for a rather rapid closing of the damper plate 38 when the furnace or water heater shuts down.

Although the invention has been described with respect to a damper plate 38 positioned approximately at a 60° angle to the axis of the flue pipe, the angle of the damper plate 38 with respect to the axis of the flue pipe can vary over a wide range depending on the desired angular length of travel of the damper plate and the selected characteristics of the bimetallic element 52. This angle can vary between 30° and up to 90°.

The opening 19 can be provided with a shutter which is operated by the bimetallic coil 52 or the damper plate 38 to close of the opening 19 when the damper plate 38 is in its closed position. Such a shutter would prevent unwanted escape of room air when the damper plate 38 is closed.

Further, an indicator (not shown) can be coupled to the bimetallic coil and/or to the damper plate 38 to show the position of the damper plate 38 from outside the flue pipe.

Reasonable variation and modification are possible within the scope of the foregoing disclosure and drawings without departing from the spirit of the invention which is defined in the appended claims.

The embodiments of the invention in which an exclusive property or privilege is claimed are defined as follows:

1. A thermally controlled damper for an exhaust flue for a combustion apparatus comprising:

a flue pipe having an inlet opening adapted to be connected to the exhaust flue from the combustion apparatus and an outlet opening for venting flue gases to the atmosphere;

a damper plate;

means mounting said damper plate in said flue pipe for rotation about an axis of rotation transverse to the axis of the flue pipe between a first position transverse to the flow of gases through the flue pipe and a second position parallel to the flow of gases through the flue pipe;

the damper plate being of a size to fit within the flue pipe and to substantially restrict the flow of gases through the flue pipe when the damper plate is in the first position;

a coil of bimetallic material mounted concentrically about the axis of rotation of the baffle plate and within the flue pipe, adjacent one side thereof to sense the temperature of gases passing through said flue pipe;

one end of said coil of bimetallic material being coupled to the flue pipe and the other end thereof being coupled to the damper plate such that said coil, when heated, rotates said damper plate from said first position to said second position; and an opening in said one side of said flue pipe adjacent said coil of bimetallic material;

said flue pipe opening and said coil being so positioned that ambient air drawn through said opening passes first through said coil of bimetallic material before being substantially diluted in flue gases in said flue pipe and then through said outlet opening in said flue pipe to cool said coil and thereby maintain an inverse relationship between draft in the flue pipe and the degree to which the damper plate moves from the first position to the second position.

2. A thermally controlled damper according to claim 1 wherein said damper plate has a slot at one side thereof and said coil of bimetallic material is positioned within said slot.

3. A thermally controlled damper according to claim 2 wherein said damper plate slot is formed by bending a flange portion of said plate perpendicular to the plane of said damper plate and said mounting means comprises a rod which extends through said flange portion.

4. A thermally controlled damper according to claim 3 and further comprising bearing means in said flange portion, said bearing means forming a journal for said rod.

5. A thermally controlled damper according to claim 4 wherein said mounting means further comprises a second flange portion bent perpendicular to the plane of said damper plate at an opposite side from said first-mentioned flange portion, said rod extending through said second flange portion.

6. A thermally controlled damper according to claim 5 and further comprising bearing means in said second flange portion and forming a journal for said rod.

7. A thermally controlled damper according to claims 1, 2 or 3 wherein said coupling means comprises means for relieving the stress on said bimetallic coil upon prolonged heating or high temperature excursions within said flue pipe.

8. A thermally controlled damper according to claim 7 wherein said stress-relieving means comprises a second coil of bimetallic material.

9. A thermally controlled damper according to claim 1 wherein said mounting means comprises a rod about which said damper plate rotates, one end of said coil of bimetallic material secured to said rod, a second coil of bimetallic material mounted concentrically about said rod and shielded from gases in said flue pipe, said second coil is attached at one end to the flue pipe and at the other end to the rod, the second coil of bimetallic material, when heated, is adapted to rotate the rod in the same rotational direction as the damper plate rotates between the first and second positions, whereby the second coil of bimetallic material relieves stress on said first bimetallic coil during prolonged temperature excursions within said flue pipe and assists in rotating said damper plate from said second position to said first position on loss of heat in said flue pipe.

10. A thermally controlled damper according to claims 1 or 9 and further comprising means to adjustably bias the damper plate in a closed position.

11. A thermally controlled damper according to claim 9 and further comprising a series of openings in said flue pipe in spaced arcuate relationship to said rod for selectively attaching said one end of said second coil to said flue pipe and thereby adjust the bias on said damper plate to a closed position.

12. A thermally controlled damper according to claim 1 and further comprising means extending through the flue pipe for manually operating the damper plate.

* * * * *